US005410115A

United States Patent [19]

Hizume et al.

[11] Patent Number: 5,410,115

[45] Date of Patent: Apr. 25, 1995

[54] ROD-TYPE SWITCH

[75] Inventors: Hiromi Hizume, Kanagawa; Jiro Aikawa, Shizuoka, both of Japan

[73] Assignees: Yazaki Corporation; SK Kohki Co., Ltd., both of Tokyo, Japan

[21] Appl. No.: 139,647

[22] Filed: Oct. 22, 1993

[51] Int. Cl.[6] ..... H01H 3/16; H01H 15/00

[52] U.S. Cl. ..... 200/61.76; 200/16 B; 200/61.62

[58] Field of Search ..... 200/61.62–61.84, 200/520–541, 16 B, 16 E

[56] References Cited

U.S. PATENT DOCUMENTS

| | | | |
|---|---|---|---|
| 4,564,730 | 1/1986 | Tomizu et al. | 200/16 B |
| 4,658,212 | 4/1987 | Ozawa et al. | 324/158 F |
| 4,681,994 | 7/1987 | Nagata et al. | 200/16 B |
| 4,739,133 | 4/1988 | Nation et al. | 200/61.62 |
| 4,795,863 | 1/1989 | Tomizu et al. | 200/16 B |

*Primary Examiner*—J. R. Scott
*Attorney, Agent, or Firm*—Sughrue, Mion, Zinn, Macpeak & Seas

[57] ABSTRACT

A rod-type switch including: a tube-like body; a conductor conducting tube fixed in the middle part of the body; a contact having on one end thereof an insulating rod extending inside the conductor tube, the other end of the contact projecting from one end of the body; a spring resiliently the contact biasing so that a part of the contact is caused to project from the body; and an electrode rod supported by the body while insulated therefrom and biased in a direction of the conductor tube by a spring so that a contact portion of the rod contacts an end of the conductor tube. As a result of the construction, an electrical circuit is formed by the body, the conductor tube and the contact portion of the electrode rod, and a switch is formed by relative movement of the contact portion with respect to the end of the conductor tube.

5 Claims, 3 Drawing Sheets

ROD-TYPE SWITCH

BACKGROUND OF THE INVENTION

The invention relates to a long rod-type switch having a small and outside diameter.

Some convention switches are capable of turning on lights or an alarm by when a door is opened or closed for security purposes. Microswitches are generally used for such purposes.

However, of even smaller type microswitches are large in thickness compared with the thickness between the door and the door frame. Further, the microswitches are easy to observe from the outside. When a large number of microswitches are to be mounted, they must be hidden or placed in an aesthetically pleasing location. Accordingly, the microswitches must be extremely small. However, even the smallest microswitches are difficult to locate and poor in durability.

SUMMARY OF THE INVENTION

To overcome the above problem, a rod-type switch S of the invention includes: a tube-like body 1; a conductor tube 4 fixed in the middle part of the body 1; a contact 2 having on one end thereof an insulating rod 6 extending inside the conductor tube 4, the Other end of the contact 2 projecting from one end of the body 1; a spring 5 resiliently biasing the contact 2 so that a part of the contact 2 is caused to project from the body 1; and an electrode rod 7 supported by the body 1 while insulated therefrom and being biased in a direction of the conductor tube 4 by a spring 11, and having a contact 7*a* which abuts an end of the conductor tube 4. As a result of the construction, an electrical circuit is formed by the body 1, the conductor tube 4 and the contact 7*a* of the electrode rod 7. An external force on the contact 2 forces the contact 2 and the insulating rod 6 connected thereto to move toward the conductor tube 4 so as to push the contact 7*a* away from the end of the conductor tube 4, thereby interrupting the electrical circuit. The rod 6 is insulating to prevent short-circuiting between the tube 4 and the contact 7*a*, and the rod 6 may be separately or integrally formed with the end 2*a* of the contact 2.

The rod-type switch S of the invention can be inserted into a small-diameter hole. The switch part X formed by the conductor tube 4 and the electrode rod 7 in contact with the conductor tube 4 can be opened and closed by pushing the contact 2 projecting from one end of the body 1. Therefore, a switch S is provided whose sectional area is extremely small and which is rod-like and durable.

Further, since the front end of the contact 2 projects from the front end of the body 1 and is biased by a predetermined resiliency of the spring 5, the switch S can be applied to, e.g., devices for checking the fixing condition of a part by applying a predetermined force to the part utilizing the resiliency of the spring 5.

DETAILED DESCRIPTION OF THE PREFERRED EMBODIMENTS

Embodiments of the invention will now be described with reference to the accompanying drawings.

Figure 1:
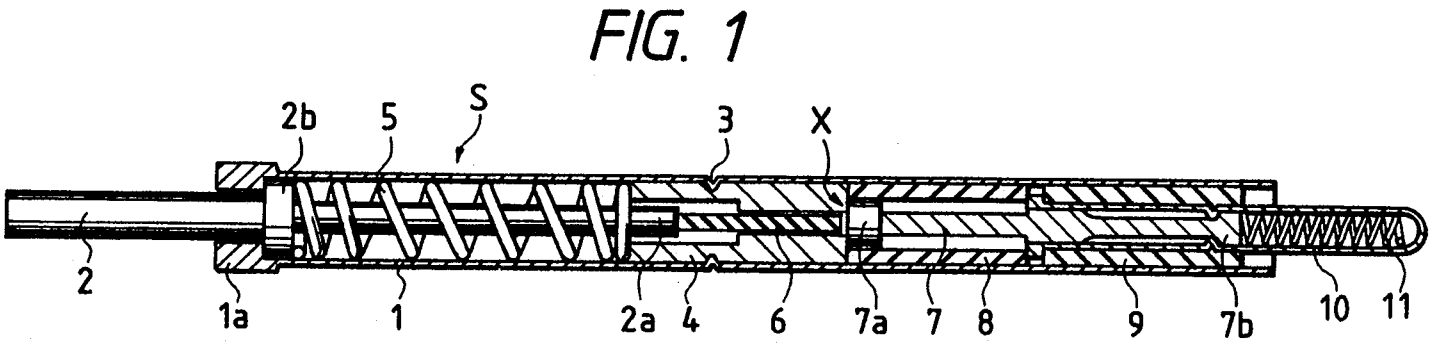
FIG. 1 is a longitudinal partial sectional view showing a switch, which is an embodiment of the invention, in enlarged form.

FIG. 1 is a partial sectional view of a rod-type switch, which is an embodiment of the invention. The switch S is formed by projecting a contact 2 made of a metal rod from a front end of a body 1 made of a cylindrical metal tube. The contact 2 is long enough to reach the middle part of the body 1. A rear end 2*a* of the contact 2 is inserted into a cylindrical conductor tube 4 that is fixed by caulking or by a restricted portion 3 in the middle part of the body 1. A spring 5 is inserted between a front end of the conductor tube 4 and a disc 2*b* so as to be resilient, the disc 2*b* being arranged with a part of the contact 2 being fully expanded inside the body 1. Because of the resiliency of the spring 5, the disc 2*b* is held while biased onto a thick part la formed on a front end of the body 1 under a predetermined pressure.

Further, a long hole (not shown) is arranged in a direction of the axial line of the rear end 2*a*. An insulating rod 6 is fixed while inserted into such long hole. A front end of the insulating rod 6 extends to the vicinity of the end of the conductor tube 4. Reference numeral 7 designates an electrode rod, which is supported by two insulating tubes 8, 9 that are fitted into the body 1 and which forms a contact 7*a* by expanding a front end thereof. With the rear end 7*b* thereof passing through the insulating tube 9, the electrode rod 7 is biased by a spring 11 that is inserted into an electrode tube body 10 that is firmly fitted into the insulating tube 9.

Therefore, the electrode rod 7 is held so that the contact 7*a* formed on one end of the electrode rod 7 is positioned in the middle of the body 1. Under the condition of FIG. 1, a switch part X (contact) is formed by relative movement of the contact 7*a* with respect to the end of the conductor tube 4. When the contact 7*a* abuts the end of the conductor tube 4, an electrical circuit is formed by the body 1, the tube 4 and the contact 7*a* of the rod 7.

The switch part X forms a normally closed contact in this embodiment. If the insulating rod 6 is shortened to increase a gap between the insulating rod 6 and the contact 7*a* and to increase the stroke of the contact 2 to thereby keep the insulating rod 6 from being easily operable by a slight movement of the contact 2, then erroneous operation of the switch S can be prevented.

Figure 2:
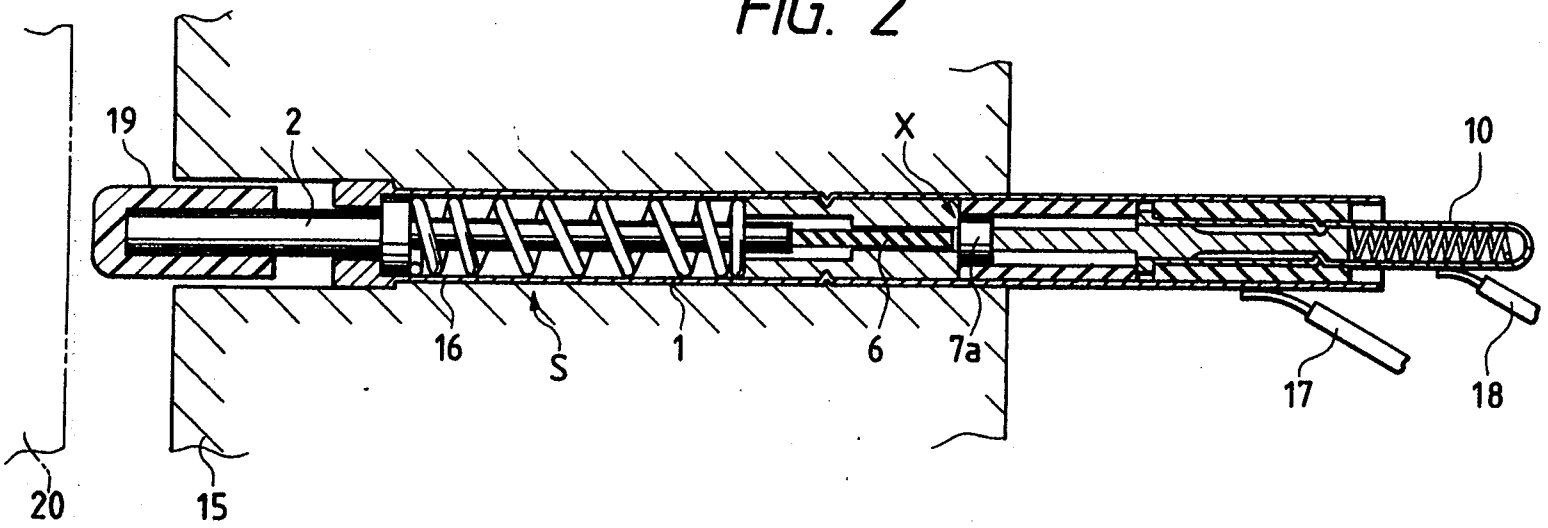
FIG. 2 is a partial sectional view showing an exemplary method of using the switch.
Figure 3:
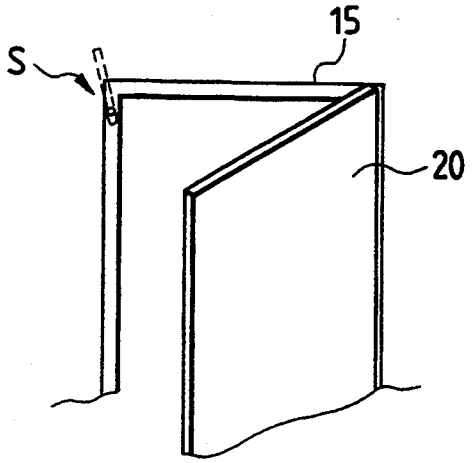
FIG. 3 is a diagram illustrative of the switch mounted on a part of a frame for opening and closing a door.

To use the thus constructed normally closed switch S, the body 1 is embedded into a frame 15 of a window or a doorway of a building while arranging a hole in the frame 15 as shown in FIG. 3. Electric wires 17, 18 are connected between the body 1 and the electrode tube body 10 fixed on the rear end of the body 1 as shown in FIG. 2 to use such wires as signal lines of a controller.

FIG. 2 is a partial sectional view showing a state in which the rod-type switch S is mounted. A mounting hole 16 is provided in the frame 15 of a door of a building. The switch S is firmly inserted into the mounting hole 16 by press fitting. The wires 17, 18 are connected to the body 1 and the electrode tube body 10 thereafter, and these are then connected to a controller (not shown). A cap 19 made from synthetic resin is fitted in the front end of the contact 2 for projection if necessary.

In FIG. 3, reference numeral 20 designates a door. When the door 20 abuts against the frame 15, the contact 2 of the switch S arranged on the frame 15 is pushed into the body 1 through contact with the cap 19. Then, the front end of the insulating rod 6 fixed on the end of the contact 2 biases the front end of the contact 7*a* formed on one end of the electrode rod 7, so that the switch part X is opened, i.e., a gap is formed between the end of the conductor tube 4 and the contact 7*a*. As a result, the wire 17 connected to the enclosure of the body 1 is electrically disconnected from the wire 18 connected to the electrode tube body 10 fixed on the other end of the body. 1.

Specific dimensions of the rod-type switch S of the invention are, e.g., as follows. The diameter of the body 1 is 3 mm; the length is about 30 mm; the projecting length of the contact 2 is 7 mm; and the projecting length of the electrode tube body 10 is in the order of 5 mm. Therefore, the rod-type switch S can be inserted into a hole at a predetermined position as if a nail is being hammered into a hole.

Other examples of how the rod-type switch S of the invention is used are housing-terminal coupling condition tests for connectors used in wire harnesses.

Figure 4:
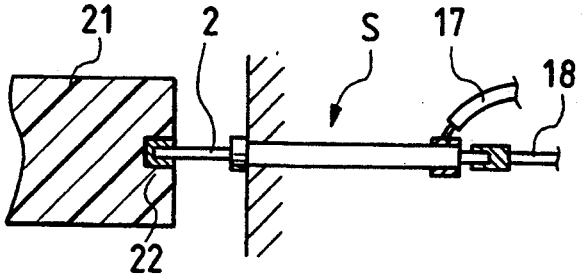
FIG. 4 is a diagram illustrative of inspection of good parts in a first exemplary method of using the switch.

The rod-type switch is used for fool-proof tests as well as defective connector tests. If the contact 2 of the rod-type switch S is not inwardly biased because the contact 2 extends into a recess or terminal 22 of a female connector 21 (shown in cross section in FIG. 4), then the switch part X remains on. Thus, the connector 21 is judged to be satisfactory, i.e., the depth of the terminal 22 is as desired.

Figure 5:
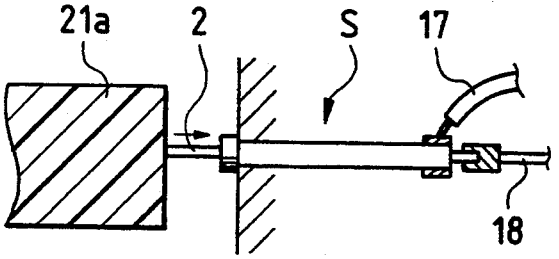
FIG. 5 is a diagram illustrative of inspection of defective parts in the first exemplary method of using the switch.

On the other hand, if a female connector 21*a* (shown in cross section in FIG. 5) does not have a recess as shown in FIG. 5, or if the recess is too shallow, so that the contact 2 is biased inwardly by the connector 21*a*, then the switch part X, which is normally closed, i.e., turns off. Thus, the female connector 21*a* is judged to be defective. By taking advantage of the turning on and off of the switch S, female connectors can be judged to be either satisfactory or defective.

Figure 6:
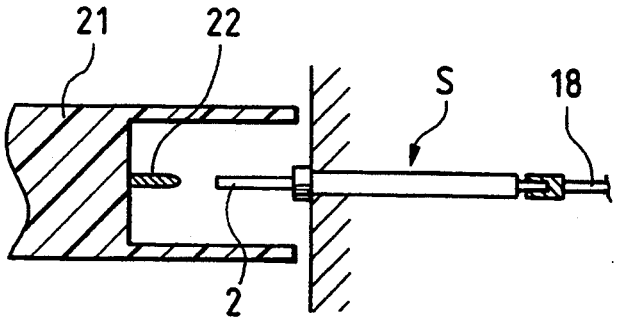
FIG. 6 is a diagram illustrative of a terminal being arranged too short in a second exemplary method of using the switch.
Figure 7:
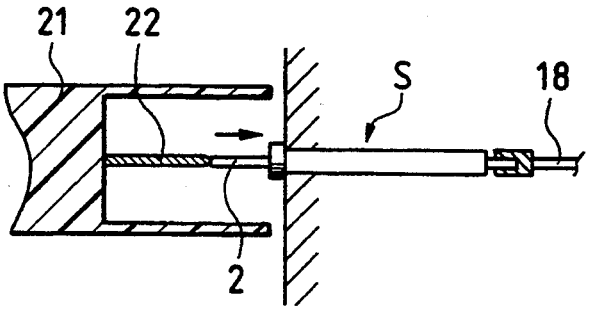
FIG. 7 is a diagram illustrative of a terminal being arranged too long in the second exemplary method of using the switch.

The rod-type switch can also be used to check whether a male conducting terminal 22 (shown in cross section in FIGS. 6 and 7) is fixed at a predetermined position in an insulating housing that constitutes a connector 21 (shown in cross section) used in a wire harness. When the terminal 22 does not project sufficiently far inside the connector 21, as shown in FIG. 6, the contact 2 of the rod-type switch S does not contact the terminal 22. Thus, the electric circuit remains energized and the operator therefore knows that the terminal 22 does not extend sufficiently far. If, on the other hand, the terminal 22 of the connector 21 extends too far as shown in FIG. 7, the contact 2 of the rod-type switch S retreats against resiliency of the spring 5 shown in FIG. 1, which in turn disconnects the electric connection between the contact 7*a* and the conductor tube 4 to alert the operator that the terminal 22 protrudes too far. By taking advantage of the turning on and off of the rod-type switch S, the proper length in the terminal 22 of the connector 21 can be determined.

Figure 8:
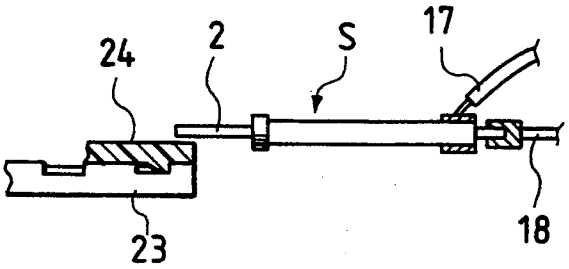
FIG. 8 is a diagram illustrative of a lance normally set to a terminal in a third exemplary method of using the switch.
Figure 9:
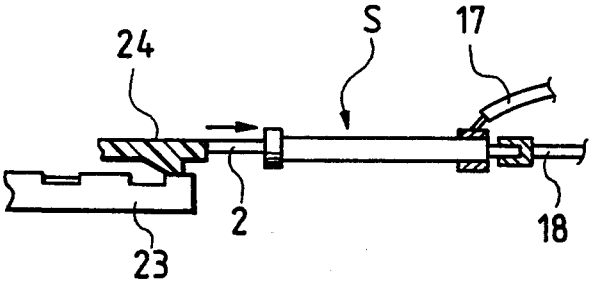
FIG. 9 is a diagram illustrative of a lance half-set to a terminal in the third exemplary method of using the switch.

The rod-type switch may also be used to detect the rising of a lance. If a lance, as shown in FIGS. 8 and 9, 24 is set into a terminal 23 correctly at a predetermined position a connector as shown in FIG. 8, the contact 2 of the rod-type switch S does not contact the lance 24, which keeps the switch part X formed of the conductor tube 4 and the electrode rod 7 of FIG. 1 turned on. As a result, the setting of the lance 24 in the terminal 23 is judged to be normal.

If, on the other hand, the lance 24 protrudes from the terminal 23 as shown in FIG. 9, the contact 2 of the rod-type switch S comes in contact with the lance 24. As a result, the contact 2 is biased to turn the switch part X off. With the switching of the switch part X from the on to the off state, the setting of the lance 24 into the terminal 23 is judged to be abnormal.

The rod-type switch of the invention includes a tube-like body; a conductor tube fixed in the middle part of the body; a contact having on one end thereof an insulating rod extending inside the conductor tube, the other end of the contact projecting from one end of the body; a spring resiliently biasing the contact so that a part of the contact is caused to project from the body; and an electrode rod being supported by the body while insulated therefrom and being biased in a direction of the conductor tube by a spring with a contact thereof coming in contact with an end of the conductor tube. As a result of the construction, a switch part is formed between the conductor tube and the contact of the electrode rod.

The resulting switch is rod-like, and looks similar to a nail. The operating part that is exposed is only a rod part of the contact whose front end proburdes only minimally. This structure of the switch requires no particular position for its installation, making the switch effective and useful as a switch for security purposes.

Further, the general structure of the switch is made rod-like by using rod-like parts. This design provides a durable switch.

Still further, the rod-type switch can be used to perform various kinds of tests such as terminal insertion tests for connectors used in wire harnesses by utilizing the switch part thereof that turns on and off with the movement of the contact.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated.

What is claimed is:

1. A rod-type switch comprising:

a conducting tube-like body (1);

a conductor tube (4) fixedly secured along an inner circumferential wall of said body (1) substantially in a middle portion of said body (1);

a contact (2) slidably secured in said body (1) and having a distal end protruding from said body (1) and a proximal end extending inside said body (1);

an insulating rod (6) connected to the proximal end of said contact (2) and extending inside the conductor tube (4);

a first spring (5) for resiliently biasing said contact (2) to protrude from said body (1);

an electrode rod (7) slidably supported inside an end of said body (1) opposite said contact 2 and insulated from said body (1); and a second spring (11) for biasing said electrode rod (7) in a direction of said conductor tube (4) so that a contact part (7*a*) of said rod (7) abuts against an end of said conductor tube (4), wherein an electrical circuit is formed by said body (1), said conductor tube (4) and the contact part (7*a*) of said electrode rod (7) which normally abuts against the end of said conductor tube (4), and wherein when an external force is applied to said contact (2) to cause said contact (2) to move against a biasing force of said first spring (5), said insulating rod (6) pushes said contact part (7*a*) and said electrode rod (7) against a biasing force of said second spring (11) so that said contact part (7*a*) and the end of said conductor tube (4), which together form a switch part (X), are separated thereby disconnecting the electrical circuit.

2. A rod-type switch according to claim 1, further comprising:

an electrode tube body (10) secured to an end of said body (1) opposite said contact (2) and insulated from said body (1), wherein said second spring (11) is contained inside said electrode tube body (10), and wherein one end of said second spring (11) is supported against an internal end of said electrode tube body (10) and an opposite end of said second spring (11) contacts and end of said electrode rod (7) opposite said contact portion (7*a*).

3. A rod-type switch according to claim 2, further comprising electric wires (17, 18) connected to said body (1) and said electrode tube body (10), respectively.

4. A rod-type switch according to claim 1, further comprising:

a cap (19) made from synthetic resin and fitted on the distal end of said contact (2).

5. A rod-type switch comprising:

a conducting elongate tube;

a conducting inner tube shorter than said elongate tube and secured inside said elongate tube, at least a portion of said inner tube contacting an inner circumferential wall of said elongate tube;

a contact slidably supported inside said elongate tube and biased so that a distal end of said contact protrudes from said elongate tube;

an insulating rod secured to a proximal end of said contact and extending inside said inner tube;

an electrode rod slidably supported inside an end of said elongate tube opposite said contact and biased towards said inner tube; and a contact portion secured to an end of said electrode rod adjacent an end face of said inner tube so as to abut the end face of said inner tube, wherein an electrical circuit is formed by the conducting elongate tube, the conducting inner tube, and the contact portion, and wherein when the elongate tube is held stationary and an external force is applied to the contact, the insulating rod pushes the contact portion of the electrode rod away from the end face of said inner tube to disconnect the electrical circuit.

* * * * *